US006428429B1

(12) United States Patent
Lee

(10) Patent No.: US 6,428,429 B1
(45) Date of Patent: Aug. 6, 2002

(54) GOLF BALL-TEE POSITIONING IMPLEMENT

(76) Inventor: Kevin Pyung Lee, 12151 Napoli Dr., Cerritos, CA (US) 90703

( * ) Notice: Subject to any disclaimer, the term of this patent is extended or adjusted under 35 U.S.C. 154(b) by 0 days.

(21) Appl. No.: 09/519,827

(22) Filed: Mar. 6, 2000

(51) Int. Cl.[7] ..... A63B 57/00
(52) U.S. Cl. ..... 473/386
(58) Field of Search ..... 473/386, 387–403

(56) References Cited

U.S. PATENT DOCUMENTS 2,943,856 A * 7/1960 Eimerman ..... 473/386
2,950,110 A * 8/1960 Slotta et al. ..... 473/386
3,473,812 A * 10/1969 Pelzmann ..... 473/396
3,540,727 A * 11/1970 Hoe, Jr. ..... 473/386
4,526,369 A * 7/1985 Phelps ..... 473/386
4,896,883 A * 1/1990 Wagenknecht ..... 473/386
5,913,737 A * 6/1999 Park ..... 473/386

* cited by examiner

*Primary Examiner*—Steven Wong
(74) *Attorney, Agent, or Firm*—Erik M. Arnhem

(57) ABSTRACT

A golf ball and golf tee can be positioned on a ball—driving area of a golf course, using a manual implement for adjusting the distance from the ball to the ground surface. The implement includes a spherical seat for the golf ball and a grooved lower section for locating the golf tee in alignment with the ball. An adjustable stop on the lower section of the implement limits the penetration of the tee into the earth surface.

10 Claims, 3 Drawing Sheets

GOLF BALL-TEE POSITIONING IMPLEMENT

BACKGROUND AND SUMMARY OF THE INVENTION

This invention relates to a manual implement for positioning a golf ball and golf tee at a driving area on a golf course or driving range. The manual implement has a first concavity fitting an outer surface of a golf ball, and a second concavity fitting the side surface of a golf tee, whereby the golf ball and golf tee can be assembled together on the implement for simultaneous positionment on a driving area.

Prior to the present invention, various implements have been suggested for positioning a golf tee and associated golf ball at a tee area on a golf course. Patents of interest are U.S. Pat. No. 5,913,737 to S. Park, U.S. Pat. No. 4,526,369 to P. Phelps, and U.S. Pat. No. 2,943,856 to G. Eimerman.

The present invention concerns a hand-held implement having a concave segmental upper section adapted to fit against a golf ball, and a generally rectangular lower section extending from said upper section for retaining a golf tee in alignment with the golf ball when the implement is held in a person's hand. The person can encircle the fingers on one hand around the implement and golf ball, to push the ball-aligned tee into the ground surface. An adjustable stop in the implement limits the penetration of the tee into the ground, to adjust the height of the ball in accordance with individual preference or particular situations.

Specific features of the invention will be apparent from the attached drawings and description of an illustrative embodiment of the invention.

DESCRIPTION OF A PREFERRED EMBODIMENT OF THE INVENTION

Figure 7:
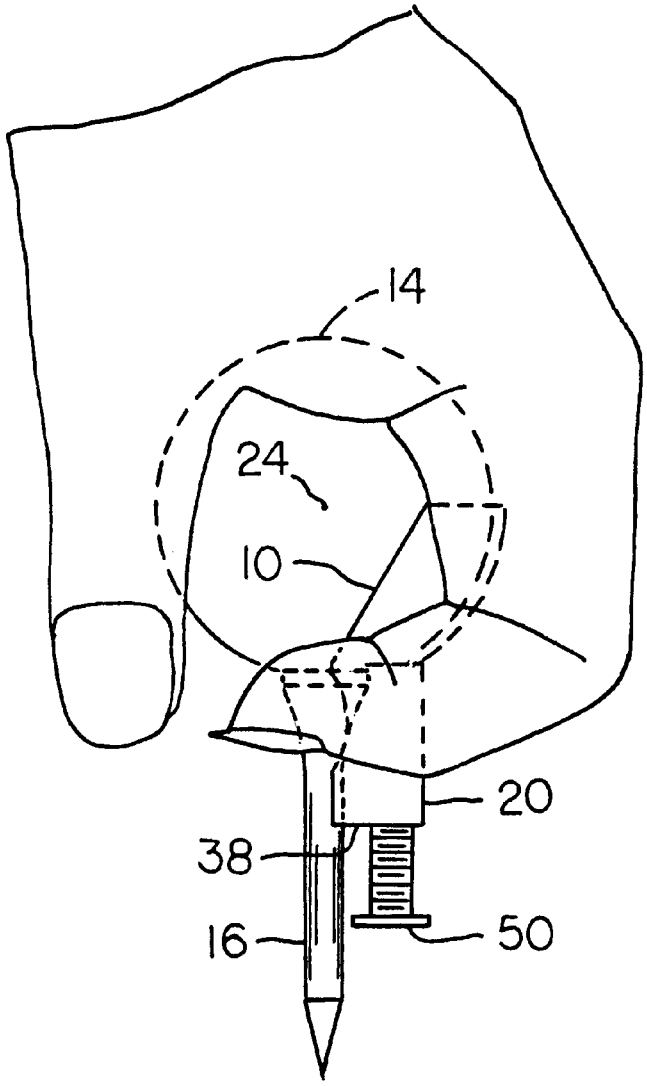
FIG. 7 is a side elevational view of the implement showing an orientation of the user's hand on the implement.

Referring to FIGS. 1 through 4, there is shown a manual implement 10 constructed according to the invention. The implement includes a positioning member 12 for positioning a golf ball 14 and a golf tee 16 in alignment with each other, such that the tee can be pushed downwardly into a ground surface to support the ball in an elevated position suitable for being driven from a tee area onto the fairway or onto a green (putting area). FIG. 7 shows the implement 10 being gripped by a person's hand, to allow the golf tee 16 to be pushed downwardly into the ground (not shown).

Positioning member 12 includes an upper section 18 that forms a seating surface for the golf ball, and a lower section 20 that forms a seating surface for the golf tee. The golf ball and golf tee can be of conventional construction.

Upper section 18 of the positioning member has a concave spherical interior surface 22 having a center of curvature 24 that is coincident with the center of the golf ball (when the ball is seated on surface 22). Surface 22 has extensive area contact with the golf ball when the ball is placed on the positioning member; the ball is immovable on surface 22.

Figure 2:
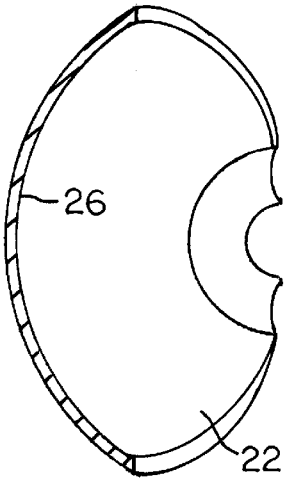
FIG. 2 is a transverse sectional view taken on line 2—2 in FIG. 1.
Figure 3:
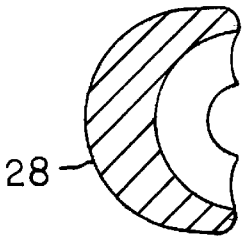
FIG. 3 is a transverse sectional view taken on line 3—3 in FIG. 1.
Figure 1:
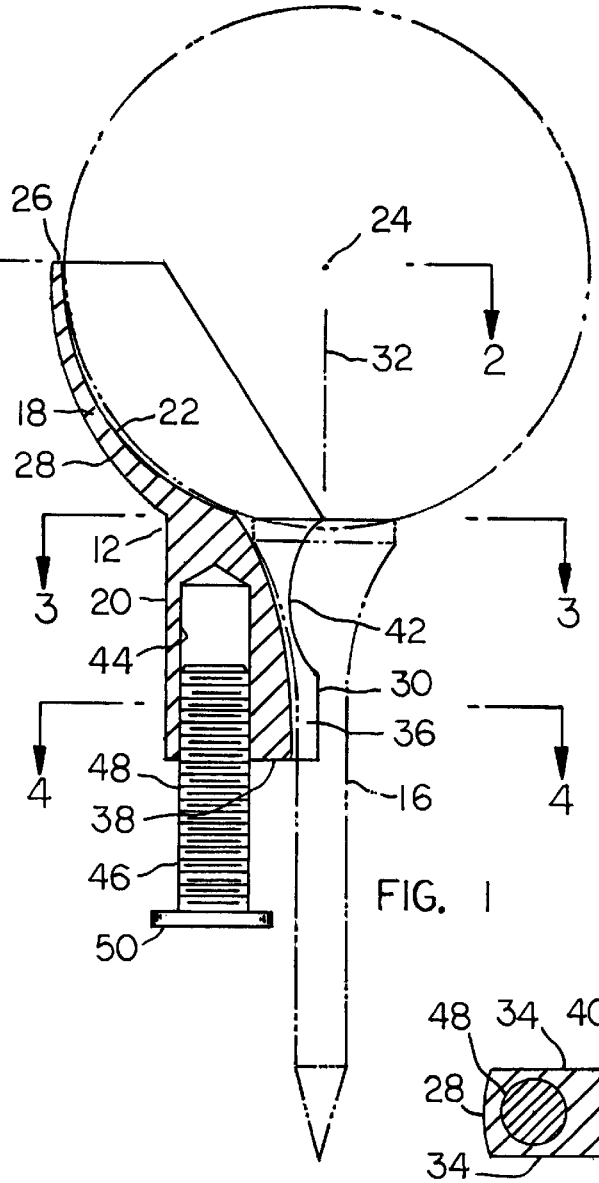
FIG. 1 is a sectional view taken through a manual implement embodying the invention. A golf ball and golf tee are shown in dashed lines to illustrate the relation between the implement and the ball-tee combination during use of the implement.

Upper section 18 of the positioning member has an upper edge 26 that is located in a horizontal plane passing through center 24 when the associated tee 16 is held in a vertical position, as shown in FIG. 1. Upper edge 26 has an arcuate configuration, as shown in FIG. 2, such that edge 26 follows the surface of golf ball 14 in a horizontal (equatorial) plane. The circumferential length of upper edge 26 is preferably about thirty percent of the ball 14 circumference, whereby concave surface 22 partially encircles the golf ball. The golf ball is stabilized on surface 22, while still permitting easy removal of the implement from the ball after the golf tee has been inserted into the ground (for positionment of the golf ball).

Concave spherical surface 22 is advantageous in that the ball is prevented from shifting or rolling off surface 22 while implement 10 is being manipulated to insert the golf tee into the ground surface. Spherical surface 22 is believed to be an improvement on the non-spherical ball seat used in aforementioned U.S. Pat. No. 5,913,737 (FIG. 7).

Upper section 18 of the positioning member has a convex spherical exterior surface 28 that has a center of curvature located in close proximity to center 24, such that the arcuate (spherical) wall formed by surfaces 22 and 28 has an essentially uniform thickness from upper edge 26 to the point where section 18 meets lower section 20. The wall thickness is relatively small, on the order of one sixteenth inch, such that exterior surface 28 follows the curvature of the golf ball for easy gripment by the person's fingers (in the FIG. 7 orientation).

Figure 4:
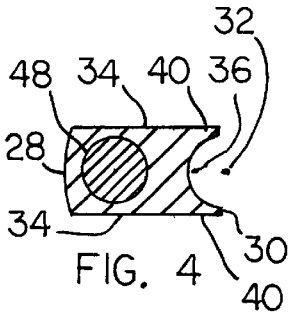
FIG. 4 is a transverse sectional view taken on line 4—4 in FIG. 1.
Figure 5:
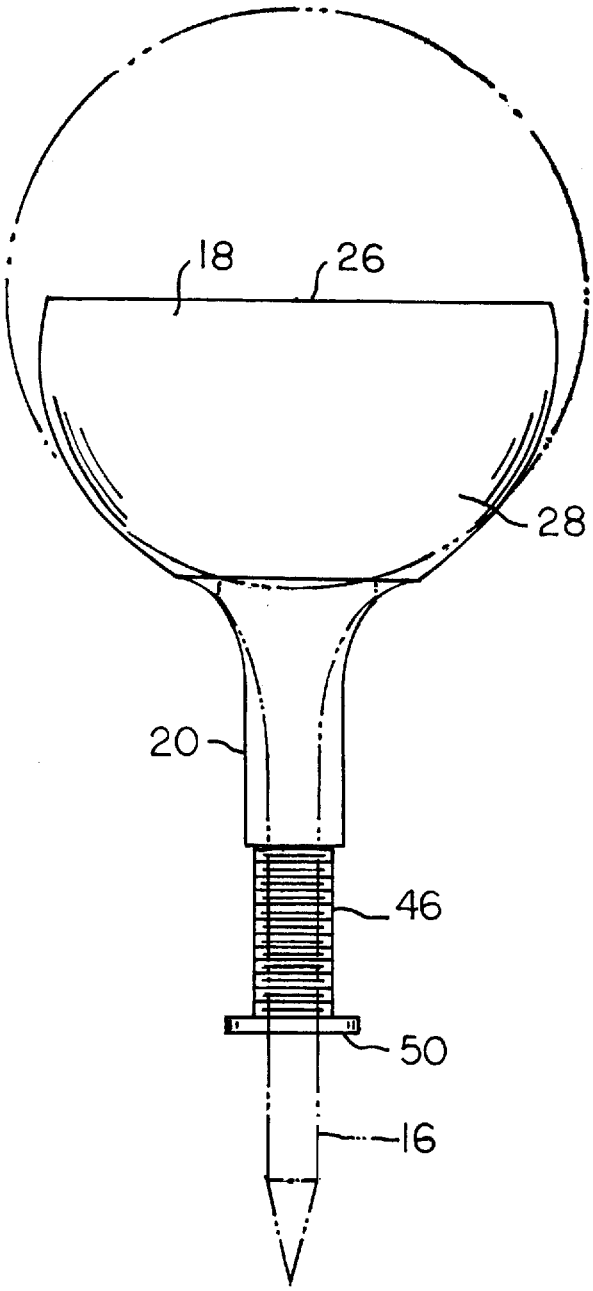
FIG. 5 is a left side elevational view of the implement shown in FIG. 1.

Lower section 20 of the positioning member is elongated down-wardly from upper section 18 that edge 30 of the lower section is slightly offset from an imaginary radius 32 extending vertically from center 24. In horizontal cross-section, the lower section 20 of the positioning member is generally rectangular, as shown in FIG. 4. Section 20 has two flat parallel side surfaces 34 that join the aforementioned side edge 30. Side surfaces 34, 34 are relatively closely spaced so that lower section 20 of the positioning member can readily fit between adjacent fingers on the person's hand, as depicted generally in FIG. 7. Typically, the spacing between the two side surfaces 34 is only about one quarter inch.

Edge 30 on lower section 20 has a longitudinal groove-like concavity 36 extending from the upper end of section 20 to the lower end surface 38. Concavity 36 is contoured to follow the side surface contour of the golf tee. As shown in FIG. 4, the concavity has a semi-circular surface contour. The concavity flares radially outwardly in the upward direction, to follow the contour of the golf tee.

The semi-circular concavity in edge 30 forms two flanges, referenced by numeral 40 in FIG. 4. The flanges are relieved (or cut away) as indicated at 42 in FIG. 1. The relief areas prevent contact between the flaring area of the golf tee and flanges 40, such that the tee is stabilized in two planes, i.e. at the upper end of concavity 36 and at the lower end of concavity 36. The golf tee has a non-wobble fit on grooved edge 30 of lower section 20.

A threaded opening 44 is formed in section 20 of the positioning member for mounting an adjustable stop 46. As shown in FIG. 1, the stop includes a threaded shank 48 in mesh with threaded hole 44, and an enlarged head 50 that is adapted to engage the ground surface, thereby limiting penetration of the golf tee into the ground. Stop 46 can be manually rotated to vary the location of head 50 and the tee penetration.

Figure 6:
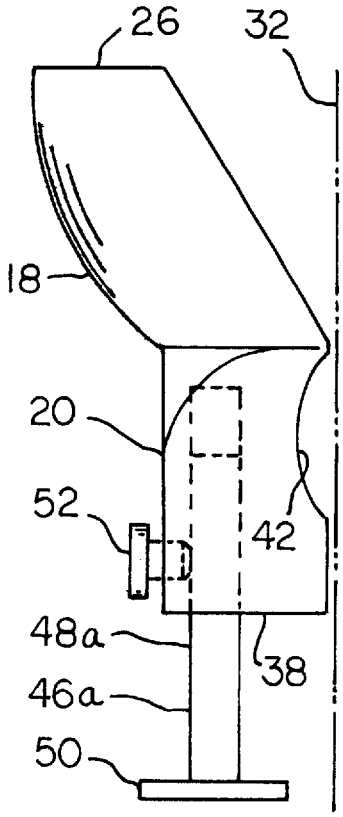
FIG. 6 is a side elevational view of a second manual implement embodying the invention.

FIG. 6 shows an alternate arrangement, wherein the adjustable stop 46*a* includes a non-circular slide element 48*a* slidably positioned in a mating guide formed in section 20 of the positioning member 12. A manually-operated set screw 52 is threaded into section 20 to clamp the stop in selected positions of adjustment.

In use of the implement (FIG. 1 or FIG. 6), the golf ball and golf tee are seated against the seating surfaces on sections 18 and 20, after which the person grips the assembly in one hand, as depicted generally in FIG. 7. The fingers are curled around the assembly, while pushing down on the golf ball, to penetrate the tee into the ground surface until head 50 on the stop contacts the ground surface. The person's hand can readily be removed with implement 10, leaving the tee and ball in place.

FIG. 7 illustrates one orientation of the person's hand on the ball and implement 10. However, the hand can grip the ball and implement 10 in various orientations. For example, the hand can be placed around the golf ball with the thumb pressing against a side surface of the golf tee. The type of grip used is a matter of individual preference.

Figure 8:
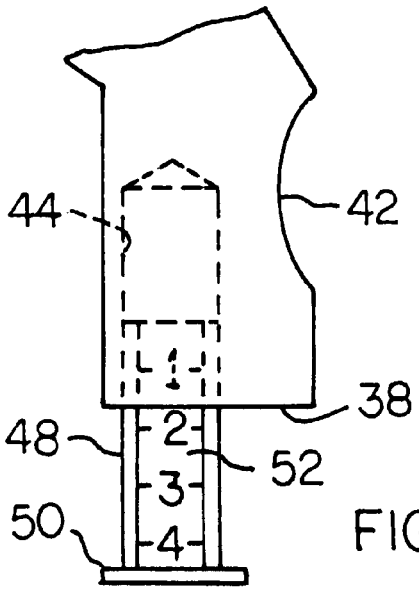
FIG. 8 is a fragmentary view, taken along directional arrow 8 in FIG. 4.

FIG. 8 illustrates a reference marking a feature that can be used with the FIG. 1 embodiment or the FIG. 6 embodiment. The feature of interest involves reference markings imprinted on a flat side surface 52 of shank 48 (or slide element 48*a*). As shown, the markings are "4" (representing a low ball position) "3" and "2" (representing intermediate ball positions) and "1" (representing a highposition of the ball). The golfer can adjust shank 48 (or slide element 48*a*) so that a selected number (1 or 2 or 3 or 4) is aligned with lower end surface 38 of member 12, according to individual preference. The reference markings on side surface 52 could be words or other indicators, e.g. "low", "intermediate"and "high". The aim is to give the golfer a readily ascertainable indication of what a given setting of shank 48 (or slide element 48*a*) means, in terms of ball position (or ball height).

A feature of some importance is the construction of lower section 20. Side surfaces 34 of section 20 are flat and unobstructed so as to fit readily between the person's fingers. The person's finger can curl under the golf ball so as to bring the ball comparatively close to the ground surface, with only a "single" finger" clearance between the ball and ground (assuming head 50 is raised to be near end surface 38). Such a small ball—ground clearance is possible at least partly because there are no obstructions or handles below the ball, as in aforementioned U.S. Pat. No. 5,913,737 (see handles 72 in FIG. 7).

The drawings necessarily show a specific embodiment of the invention. However, it will be appreciated that the invention can take various forms and configurations, and may be manufactured in different suitable materials, such as plastic, aluminum, etc.

What is claimed:

1. An implement for positioning a golf ball and golf tee in a position suitable for driving the golf ball from a driving area, said implement comprising:

a positioning member having an upper section and a lower section; said upper section having a concave spherical interior surface adapted to conform to a lower side surface of a golf ball, and a convex spherical exterior surface adapted for gripment by a person's fingers, whereby said member can be held in a fixed position against the golf ball;

said lower section of the positioning member extending downwardly from said upper section in a direction slightly offset from an imaginary radius generated from the center of said concave spherical interior surface; said lower section having a longitudinal side edge extending generally parallel to said radius; said side edge having a semi-circular concavity conforming to the side surface contour of a golf tee, whereby the tee is enabled to fit against said lower section of the positioning member while being aligned with the center of the golf ball;

said lower section of the positioning member having two parallel side surfaces joined to said side edge so that said lower section is enabled to fit between the person's fingers gripping the exterior spherical surface of the aforementioned upper section; and an adjustable stop mounted within said lower section of the positioning member for adjustment along a line parallel to said imaginary radius, whereby said stop is enabled to limit penetration of the golf tee into a ground surface.

2. The implement of claim 1, wherein said adjustable stop comprises a screw having mesh engagement with a threaded hole in the lower section of the positioning member.

3. The implement of claim 1, wherein said adjustable stop comprises a slide element and a set screw threaded into the lower section of the positioning member for clamping said slide element in selected positions of adjustment.

4. The implement of claim 1, wherein the side surfaces of said lower section are closely spaced so as to readily fit between a person's fingers.

5. The implement of claim 1, wherein the spacing between the side surfaces of said lower section is about one quarter inch.

6. The implement of claim 1, wherein the upper section of said positioning member has an arcuate upper edge locatable in a horizontal plane passing through the center of the golf ball when the golf tee is inserted into a ground surface.

7. The implement of claim 6, wherein said arcuate upper edge has a circumferential length that is approximately thirty percent of a golf ball circumference for easy removal thereof.

8. The implement of claim 1, wherein the semi-circular concavity in the side edge of said lower section is flared upwardly and away from said imaginary radius.

9. The implement of claim 8, wherein said longitudinal side edge of said lower section forms two spaced flanges for confining a golf tee therebetween; said flanges being relieved at selected locations therealong so that said flanges contact the golf tee only near the upper and lower ends of said lower section.

10. The implement of claim 1, wherein the diameter of said semi-circular concavity is only slightly less than the spacing between said parallel side surfaces so that said lower section of the positioning member is adapted to readily fit between a person's fingers; the offset between said lower section and the aforementioned imaginary radius being such that one of the person's fingers can extend along one of a golf tee to retain the golf tee within the semi-circular concavity.

* * * * *